US010112630B2

(12) United States Patent
Perraud et al.

(10) Patent No.: US 10,112,630 B2
(45) Date of Patent: Oct. 30, 2018

(54) BOGIE FRAME FOR A RAILWAY VEHICLE, ASSOCIATED BOGIE AND METHOD FOR MANUFACTURING SUCH A BOGIE FRAME

(71) Applicant: ALSTOM TRANSPORT TECHNOLOGIES, Levallois-Perret (FR)

(72) Inventors: Laurent Perraud, Saint Jean de Trezy (FR); Michaël Lafay, Germain du Plain (FR); Christophe Rosenthal, Givry (FR); Raymond Gaborit, Saint Remy (FR); Jean-François Dumontet, Saint Sernin du Bois (FR)

(73) Assignee: Alstom Transport Technologies, Saint-Ouen (FR)

( * ) Notice: Subject to any disclaimer, the term of this patent is extended or adjusted under 35 U.S.C. 154(b) by 238 days.

(21) Appl. No.: 14/958,718

(22) Filed: Dec. 3, 2015

(65) Prior Publication Data

US 2016/0159374 A1 Jun. 9, 2016

(30) Foreign Application Priority Data

Dec. 4, 2014 (FR) ..... 14 61928

(51) Int. Cl.
*B61F 5/52* (2006.01)

(52) U.S. Cl.
CPC ..... *B61F 5/52* (2013.01)

(58) Field of Classification Search
CPC ..... B61F 3/00; B61F 3/02; B61F 5/00; B61F 5/02; B61F 5/04; B61F 5/38; B61F 5/40; B61F 5/50; B61F 5/52
See application file for complete search history.

(56) References Cited

U.S. PATENT DOCUMENTS

| | | | | |
|---|---|---|---|---|
| 579,195 | A | 3/1897 | Turner | |
| 2013/0213258 | A1* | 8/2013 | Chang | B23K 31/003 105/206.2 |
| 2013/0220165 | A1 | 8/2013 | Goding | |

FOREIGN PATENT DOCUMENTS

| | | | |
|---|---|---|---|
| CN | 201189868 | Y | 2/2009 |
| CN | 201189870 | Y | 2/2009 |
| FR | 931591 | A | 2/1948 |

OTHER PUBLICATIONS

Search Report dated Aug. 3, 2015 in FR priority application No. 1461928.

* cited by examiner

*Primary Examiner* — Robert J McCarry, Jr.
(74) *Attorney, Agent, or Firm* — Knobbe, Martens, Olson & Bear, LLP

(57) ABSTRACT

A bogie frame for a railway vehicle includes at least two stringers. Each of the stringers has two flanks and at least one central core linking the two flanks to each other. The two flanks and the central core of each stringer are each formed from a cut metal sheet that is substantially planar and not folded. The vehicle also includes at least one transverse tube linking the two stringers to each other.

10 Claims, 2 Drawing Sheets

BOGIE FRAME FOR A RAILWAY VEHICLE, ASSOCIATED BOGIE AND METHOD FOR MANUFACTURING SUCH A BOGIE FRAME

CROSS-REFERENCE TO RELATED APPLICATIONS

This application claims priority to French Patent Application No. FR 14 61928 filed on Dec. 4, 2014, the disclosure of which including the specification, the drawings, and the claims is hereby incorporated by reference in its entirety.

TECHNICAL FIELD OF THE INVENTION

The present invention relates to a bogie frame for a railway vehicle comprising:

- at least two stringers, each one comprising, two flanks, at least one central core, the central core of a stringer linking the two flanks of the stringer to each other,
- at least one transverse tube linking the two stringers to each other.

The invention also relates to a bogie comprising such a frame.

The invention also relates to a railway vehicle comprising at least such a bogie.

The invention relates, in addition, to a manufacturing method of such a bogie frame for a railway vehicle.

BACKGROUND OF THE INVENTION

In the field of railway vehicles, for example of such type as the freight wagon, it is a known technology to manufacture bogie frames comprising stringers having a characteristic shaped form, for example, in the form of a rectilinear bar, by means of box shaped casings on which are welded folded metal sheets.

However, the quality of the welds of such bogie frames is not optimal due to the lack of penetration of the welds, which results in making the frame less robust.

Moreover, the box shaped casing forming the stringers present problems related to sealing.

Finally, the mass of the bogie frame is quite significant on account of the box shaped casing, which, as a consequence thereof, makes it more difficult to handle and manufacture.

One of the goals of the invention is thus to overcome these disadvantages by providing a bogie frame for a railway vehicle that is lightweight, and sealed tight, while also being easily controllable and simple to manufacture.

To this end, the invention relates to a bogie frame for a railway vehicle of the abovementioned type in which the two flanks and the central core of each stringer are each formed from a cut metal sheet which is substantially planar and not folded.

SUMMARY OF THE INVENTION

The use of metal sheets that are cut and not folded make it possible to do away with using a support such as a box shaped casing in order to manufacture the bogie frames. The substantially planar metal sheets are, indeed, directly welded one to another in order to form the bogie frames. Thus, it is possible to overcome the sealing related problems of the bogie frame because the box shaped casing no longer exists. In addition, assembling and directly welding all of the substantially planar metal sheets in order to form the stringers provides the ability to improve the quality of the welds. In addition, the bogie frame is much lighter because of the absence of the box shaped casing in particular and has greater strength and resistance due to the absence of the folded metal sheets. Finally, the manufacture is simpler and the bogie frame is more easily controllable.

The bogie frame also comprises one or more of the following characteristic features:

- each flank of each stringer comprises a central part extending along a longitudinal axis and two exterior parts extending along the longitudinal axis, the two exterior parts being distributed along the longitudinal axis on either side of the central part and each one forming an angle with the central part of the flank;
- the central core of each stringer links the central parts of the flanks of the stringer to each other, and in that a stringer comprises at least two end cores linking, two by two, the exterior parts of the flanks of the stringer belonging to two separately distinct flanks, each end core being formed from a cut metal sheet that is substantially planar and not folded;
- the exterior parts of the flanks of each stringer located at one of the ends of the central parts of the flanks of the stringer are symmetrical to the exterior parts of the flanks of the stringer located at the other end of the central parts of the flanks of the stringer in relation to a vertical plane passing through the center along the longitudinal axis of the central parts of each stringer, and in that the end cores of one flank follow the shape of the exterior parts of the flank and are each symmetrical to one another in relation to the plane;
- the central core and the end cores of a stringer are welded on to the transverse tube and to the flanks of the stringer;
- the bogie frame comprises two transverse end tubes linking the exterior parts of different separate stringers and two central transverse tubes linking the central parts of different separate stringers;
- at least one stringer comprises at least one rib linking the flanks of the stringer to one another;
- at least one rib has a function of support of an anti-roll bar.

The invention also relates to a bogie comprising such a frame.

The invention further relates to a manufacturing method of a bogie frame for a railway vehicle, the method comprising the following steps:

- the supply of cut metal sheets which are substantially planar and not folded in order to form stringers;
- the supply of at least one transverse tube;
- the assembling of the metal sheets to form at least two stringers, each one comprising, two flanks, at least one central core, the central core of a stringer linking the two flanks of the stringer to one another; and
- the assembling of the stringers by making use of the transverse tube in order to form a bogie frame.

BRIEF DESCRIPTION OF THE DRAWINGS

Other aspects and advantages of the invention will become apparent after the reading of the description that follows, given purely as an example and with reference being made to the annexed drawings, in which.

DETAILED DESCRIPTION OF SOME EMBODIMENTS

In the description, the term "longitudinal" is defined relative to the direction along which the vehicle to which the bogie belongs, is travelling, that is to say, the direction in which extend the rails over which the vehicle is travelling. The term "transverse" is defined in relation to a direction that is substantially perpendicular to the longitudinal direction in a horizontal plane, that is to say, the direction along which the rails are apart at a distance from each other. The terms "front" and "rear" are defined in relation to the direction of travel of the railway vehicle to which the bogie belongs. The direction perpendicular to the longitudinal direction and to the transverse direction is called "vertical direction".

Figure 1:
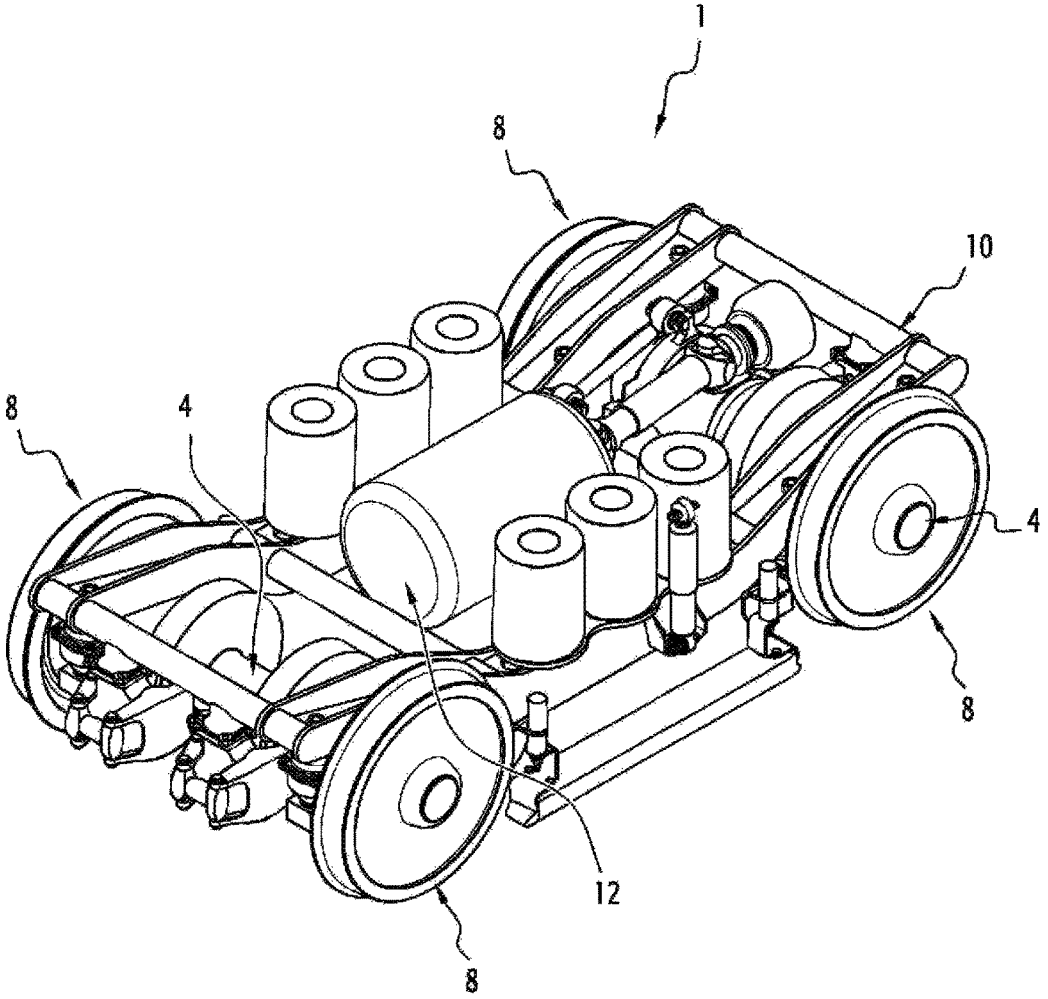
FIG. 1 is a schematic representation of a bogie comprising a bogie frame according to the invention.

A bogie 1 for a railway vehicle is represented in FIG. 1.

The bogie 1 comprises two axles 4 each one extending substantially along the transverse direction, two wheels 8 per axle 4 fastened to the transverse extreme or outermost parts of the corresponding axle 4. Furthermore, the bogie 1, in addition, comprises a frame 10 extending substantially along a longitudinal direction and bearing on each of the longitudinal extreme parts thereof one of the axles 4, and means of suspension that fasten each axle 4 to the frame 10.

In the case of a motor bogie, the motor 12 is configured in order to be mounted and secured below a body of a railway vehicle in the center of the bogie 1. In this case, the motor 12 is not secured on to the frame 10. The motor 12 is linked to a bridge fastened on to at least one axle 4 by means of a cardan shaft.

The frame 10 comprises, in addition, various members that provide the ability to drive the axles 4 in rotation, around their transverse axis, in relation to the frame 10 and possibly other functional elements of the railway vehicle.

Outside of its frame 10 such a bogie 1 is quite conventional and will not be described more in detail here.

Figure 2:
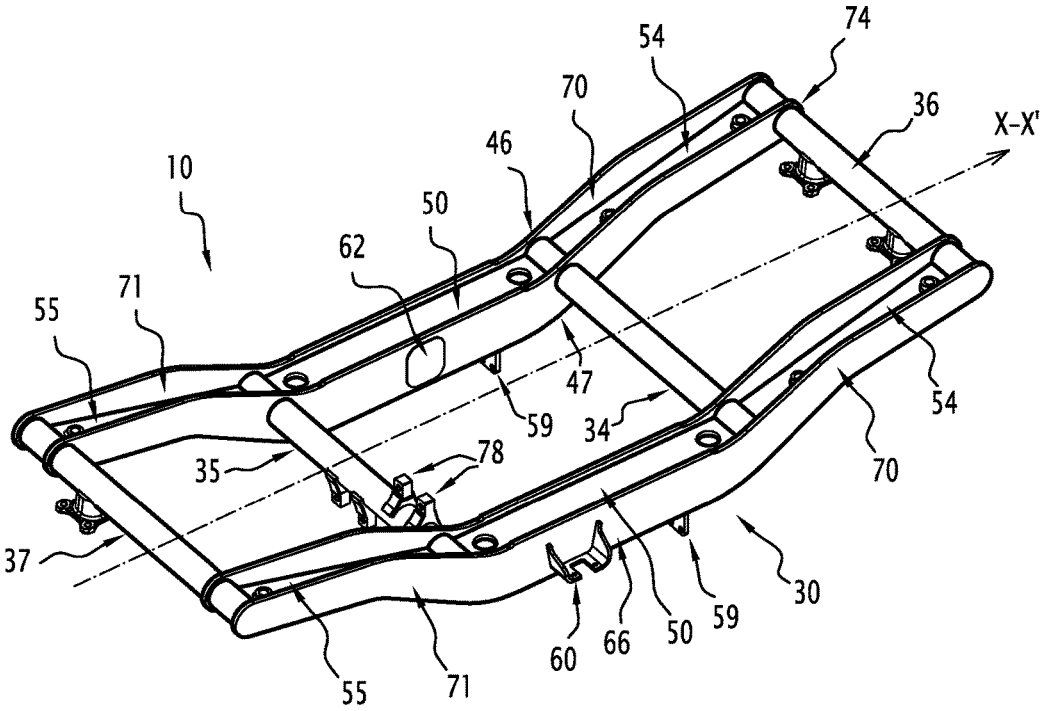
FIG. 2 is a schematic view from the top of the bogie frame shown in FIG. 1.
Figure 3:
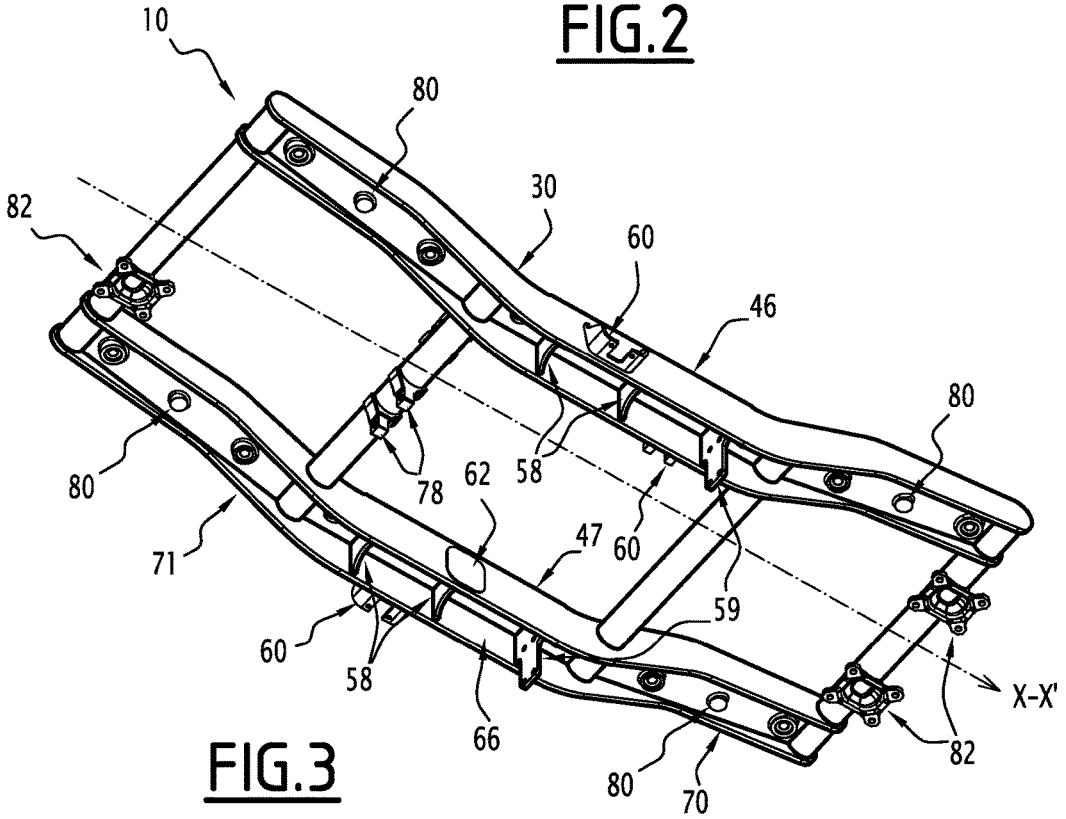
FIG. 3 is a schematic view from below of the bogie frame shown in FIG. 2.

According to the embodiment shown in the FIGS. 2 and 3, the frame 10 of the bogie 1 comprises two stringers 30 and four transverse tubes 34, 35, 36, 37 linking the two stringers 30 to one another.

In a variant, the frame 10 presents more than two stringers 30 and/or more or less than four transverse tubes 34, 35, 36, 37.

Each stringer 30 comprises two flanks 46, 47, at least one central core 50, and two end cores 54, 55.

According to one embodiment, each stringer 30 comprises, in addition, three ribs 58, 59 (visible in the FIG. 3) and multiple support mounts for shock absorber 60.

In addition, at least one of the stringers 30 is equipped with a lateral end stop 62.

The flanks 46, 47 of each stringer 30 are made out of sheet metal having a thickness comprised between 6 millimeters (mm) and 24 mm. The term metal sheet is used to refer to a thin sheet of metal, for example of steel, obtained by a process of rolling.

The metal sheet forming the flanks 46, 47 of each stringer 30 is not folded and is substantially planar, the metal sheet of each of the flanks 46, 47 having been cut out from a sheet of much larger dimensions.

Each flank 46, 47 has a length along the longitudinal direction measuring between 2 meters (m) and 4 m.

The first flank 46 of each stringer 30 is the flank of the stringer that is disposed towards the exterior of the frame 10. Conversely, the second flank 47 of each stringer 30 is the flank of the stringer that is disposed towards the interior of the frame 10, that is to say, disposed so as to be facing the other stringer 30.

It is defined by the term "interior of the frame 10", the space delimited by the flanks 47 of each stringer 30 and the transverse tubes 34, 35, 36, 37 located at the end of the frame 10 along the longitudinal direction.

Conversely, the term "exterior of the frame 10", is used to define the complementary space within the interior of the frame 10 in the mathematical sense of the term.

For each of the stringers 30, each of the flanks 46, 47 comprises a central part 66 extending along the longitudinal direction along a longitudinal axis X-X', and two exterior parts 70, 71 extending along the longitudinal axis X-X'.

The exterior parts 70, 71 of each flank 46, 47 are distributed along the longitudinal axis X-X' on either side of the central part 66 this flank 46, 47. In other words, the central part 66 of each flank 46, 47 is linked to each of the exterior parts 70, 71 of this flank 46, 47. In particular, the first exterior part 70 of each flank 46, 47, located at the front of the frame 10, is the extension of the front of the central part 66 of the corresponding flank 46, 47. Similarly, the second exterior part 71 of each flank 46, 47, located at the rear of the frame 10, is the extension of the rear of the central part 66 of the corresponding flank 46, 47.

Each exterior part 70, 71 of each flank 46, 47 forms an angle with the central part of this flank 46. In particular, the angles formed between the central part 66 and each of the exterior parts 70, 71 of this flank 46, 47 are equal in absolute value. The absolute value of the angle formed is comprised between 10 degrees (°) and 45°.

The first exterior part 70 of each flank 46, 47 is symmetrical to the second exterior part 71 of this flank 46, 47 in relation to a vertical plane passing through the center along the longitudinal axis X-X' of the central part 66 of this flank 46, 47.

Each exterior part 70, 71 of each flank 46, 47 presents a same curvature, of angle whose absolute value is comprised between 10° and 45°.

The second flank 47 of each stringer 30 has four holes 74 that allow for the passage of the transverse tubes 34, 35, 36, 37 having axes that are substantially perpendicular to the second flank 47. Two of these holes are located at the front and rear ends of the central part 66 of each second flank 47, another one is located at the front end of the first end part 70 of each second flank 47 and the last one is located at the rear end of the second end part 70 of each second flank 47. The diameter of the holes 74 is adapted to the diameter of the transverse tubes 34, 35, 36, 37. the diameter of the holes 74 is, for example, comprised between 80 mm and 200 mm.

Preferably, the number of holes 74 in the second flanks 47 of the stringers 30 is equal to the number of transverse tubes 34, 35, 36, 37 of the frame 10.

The central core 50 of each stringer 30 is made out of sheet metal that is not folded, and substantially planar and having a thickness comprised between 12 mm and 24 mm. The metal sheet forming the central core 50 of each stringer 30 is a cut out from a larger dimensioned metal sheet.

The central core 50 has a rectangular form with dimensions comprised between 500 mm and 1500 mm along the longitudinal direction and dimensions comprised between 120 mm and 240 mm along the transverse direction.

The central core 50 of each stringer 30 is drilled with at least one hole having a diameter comprised, for example, between 38 mm and 42 mm, allowing for the evacuation of water in the upper part of the stringer 30 and extending along an axis that is substantially perpendicular to the central core 50. As visible in the FIG. 2, each central core 50 is drilled with two holes. Each of these holes is located at one of the ends along the longitudinal direction X-X' of the central core 50.

The central core 50 of each stringer 30 is capable of linking one to the other two central parts 66 of the flanks 46, 47 stringer 30. In particular, the longitudinal part of the central core 50 of each stringer 30 is, in particular, welded on to the central part 66 each flank 46, 47.

The end cores 54, 55 of each stringer 30 are made out of metal sheets that are substantially identical to the metal sheets forming the central core 50 of the stringer 30. The end cores 54, 55 are therefore formed from a metal sheet cut out, which is substantially planar and not folded.

Each end core 54, 55 is drilled with at least one hole having a diameter comprised between 13 mm and 26 mm extending along an axis that is substantially perpendicular to the end core 54, 55. Such holes are adapted for enabling the through passage and the fastening of bolts or screws, in particular. As visible in FIG. 2, each end core 54, 55 has two holes with the same diameter drilled therein and located in the front and rear ends of each of the end cores 54, 55. A boss 80 serving as primary suspension bottom end stop is welded in the bottom part of each of the end cores 54 and 55, between the two holes along the longitudinal direction.

The first end core 54 of each stringer 30 is located at the front of the stringer 30.

The first end core 54 of each stringer 30 links the first exterior parts 70 of the flanks 46, 47 of the stringer 30 to each other. The first end core 54 of each stringer 30 is, in particular, welded on to the first exterior part 70 of each flank 46, 47. The first end core 54 of each stringer 30 is, in particular, welded on to the surfaces of the first exterior parts 70, with these surfaces being located so as to be facing one another.

The second end core 55 of each stringer 30 is located at the rear of the stringer 30.

The second end core 55 of each stringer 30 links the second exterior parts 71 of the flanks 46, 47 of the stringer 30 to one another. The second end core 55 of each stringer 30 is, in particular, welded on to the second exterior part 71 of each flank 46, 47. The second end core 55 of each stringer 30 is, in particular, welded on to the surfaces of the second exterior parts 71, with these surfaces being located so as to be facing one another.

The end cores 54, 55 of each stringer 30 embraces the form of the exterior parts of the flanks 46, 47 of the stringers 30 which are linked by these end cores 54, 55.

In particular, the first end core 54 is symmetrical to the second end core 55 in relation to a vertical plane passing through the center along the longitudinal axis X-X' of the central parts of each stringer 30.

Each rib 58, 59 protrudes out in relation to the lower surface of the central core 50 of each stringer 30. The term "lower surface of the central core 50", is understood to refer to the surface of the central core 50 that is oriented towards the rails of the vehicle on which the bogie frame is designed to be installed.

Each rib 58, 59 has a form that is substantially planar and extends in a plane that is substantially perpendicular to the plane of the central core 50 and to the planes of the flanks 46, 47. The dimensions of each rib 58, 59 are, for example, equal to 150 mm along the vertical direction and are substantially identical along the transverse direction to the dimensions of the central cores 50.

Each rib 58, 59 is made out of a metal sheet whose thickness along the longitudinal direction is comprised between 10 mm and 24 mm.

Each rib 58, 59 links by means of welding the two flanks 46, 47 of each of the stringers 30. More precisely, each rib 58, 59 links the central parts 66 of the flanks 46, 47 of each stringer 30 to each other.

As visible in FIG. 3, each stringer 30 has three ribs 58, 59.

In a variant, each stringer 30 has less than three ribs 58, 59 or more than three ribs 58, 59.

With reference to FIG. 3, each stringer 30 comprises two simple ribs 58 and one complex rib 59 configured in order to serve as support for anti-roll bars.

The term "anti-roll bar" is understood to refer to a part of the suspension of a vehicle that is used to stabilize the vehicle while also reducing the effects of cornering or turning and of the irregularities of the route on which the vehicle is travelling.

The support mounts for shock absorber 60 serve as support for linking the vertical shock absorbers to the frame 10. In a variant, or in addition, each stringer 30, also comprises support mounts for transverse shock absorbers that provide the ability to link the transverse shock absorbers to the frame 10.

As visible in the FIGS. 2 and 3, one of the two stringers 30 comprises a support mount for shock absorber 60 and the other stringer 30 comprises two support mounts for shock absorbers 60. In a variant, each stringer comprises more than two support mounts for shock absorbers 60.

Each of the support mounts for shock absorbers 60 is attached by welding to the central parts 66 of the flanks 46, 47 not located to be face-to-face with each other.

The lateral end stop 62 is made, for example, out of manganese steel. The dimensions of the lateral end stop 62 are, for example, 160 mm along the longitudinal direction and 180 mm along the vertical direction. The thickness of the lateral end stop 62 in the transverse direction is, for example, comprised between 4 mm and 10 mm.

The function of the lateral end stop 62 is to limit the lateral movements between the body of the railway vehicle and the frame 10. Indeed, the material from which the lateral end stop 62 is made, manganese steel, makes it possible to limit the shear friction in the plane of the lateral end stop 12.

The lateral end stop 62 is fixed by welding on the second flank 47 of one of the stringers 30. In particular, this lateral end stop 62 is fixed on the surface of the second flank 47 not located so as to be facing one of the surfaces of the first flank 46.

The transverse tubes 34, 35, 36, 37 are used to link the two stringers 30 to one another.

The transverse tubes 34, 35, 36, 37 for example, have a length equal to 1260 mm along the transverse direction.

In a variant, the length of the transverse tubes 34, 35, 36, 37 along the transverse direction is adaptable according to the spacing of the rails on which the vehicle is travelling. The diameter of the transverse tubes 34, 35, 36, 37 is comprised between 80 mm and 200 mm depending on the load that the frame 10 is capable of transporting.

The transverse tubes 34, 35, 36, 37 are made of metallic materials, for example, steel or alloys.

The transverse tubes 34, 35, 36, 37 are configured so as to be introduced into the holes 74 of the second flanks 30 of each stringer 47.

The transverse tubes 34 and 35 are central tubes, referred to subsequently by the term "central tubes" and located in the center of the frame 10. The central tubes 34, 35 link the central parts 66 of two distinctly separate stringers 30. The central tubes 34 and 35 are linked by means of welding to the central core 50 and end cores 54, 55 of each stringer 30. In particular, the central tube 34 is linked by welding to the front part of the central core 50 of each stringer 30 and to the rear part of the first end core 54 of each stringer 30, while the central tube 35 is linked by welding to the rear part of the central core 50 of each stringer 30 and to the front part of the second end core 55 of each stringer 30.

The central tubes 34, 35 are also welded on to the central parts 50 of the first flanks 46 of each stringer 30. In particular, the central tubes 34, 35 are welded on to the interior surface of the central part 50 of each first flank 46. The term "interior surface of the central part 50", is used to refer to the surface of the central part 50 of a flank 46 that is oriented towards the interior of the frame 10.

The transverse tubes 36 and 37 are end tubes referred to subsequently by the term "end tubes" and located at the ends of the frame 10. The end tubes 36, 37 link the exterior parts 70, 71 of the distinctly separate stringers 30. The end tubes 36, 37 are linked by welding to the end cores 54, 55 of each stringer 30. In particular, the end tube 36 is linked by welding to the front part of the first end core 54 of each stringer 30, whereas the other end tube 37 is linked by welding to the rear of the second end core 55 of each stringer 30.

The end tubes 36, 37 are also welded on to the exterior parts 70, 71 of the first flanks 46 of each stringer 30. In particular, the end tubes 36, 37 are welded on to the interior surfaces of the exterior parts 70, 71 of each first flank 46. The term "interior surface of an exterior part 70, 71", is used to refer to the surface of the exterior part 70, 71 of a flank 46 oriented towards the interior of the frame 10.

The transverse tubes 34, 35, 36, 37 comprise multiple support mounts for linking rods 78 and multiple support mounts for brakes 82.

As visible in the FIGS. 1 and 2, the support mounts for linking rods 78 are four in number. However, it is quite possible for the transverse tubes 34, 35, 36, 37 to comprise more or less support mounts for linking rods 78.

In FIG. 2, are represented four support mounts for linking rods 78: two support mounts for the drive linking rod, and two support mounts for deck reaction rod.

The term "drive linking rod", is used to refer to a rod that links the bogie frame to the body of the vehicle and which is used to drive the body in the case of a motor bogie or drive the bogie in the case of a carrying bogie. The term "deck reaction linking rod", is used to refer to a rod that links the deck to the bogie frame, which makes it possible to absorb the forces and prevent the rotation of the deck.

For example, as visible in FIGS. 1 and 2, the support mounts for linking rods 78 are fixed by welding to one of the central tubes 34, 35.

As visible in FIG. 3, the support mounts for brakes 82 are three in number. However, it is quite possible for the transverse tubes 34, 35, 36, 37 to comprise more or less support mounts for brakes 82.

The support mounts for brakes 82 are able to be linked to braking actuators.

The support mounts for brakes 82 are arranged on the end tubes 36, 37 in a manner such as to protrude out towards the rails of the vehicle on which the frame 10 of the bogie 1 is designed to be installed.

The manufacturing method for manufacturing a frame 10 for the bogie 1 according to the invention will now be described.

The manufacturing method comprises, initially, a supply step for the provision of cut metal sheets that are substantially planar and not folded in order to form the flanks 46, 47, the central cores 50 and the end cores 70, 71 of the stringers 30. The metal sheets are, for example, obtained by cutting out sections from large dimensioned metal side panels.

The manufacturing method comprises, subsequently, a step of supplying at least one transverse tube 34, 35, 36, 37. In order to fabricate the frame 10 visible in FIGS. 2 and 3, four transverse tubes 34, 35, 36, 37 are supplied during this supply step. The transverse tubes 34, 35, 36, 37 are, for example, obtained by means of extrusion.

Furthermore, the manufacturing method also comprises a supply step for the supply of ribs 58, 59, of support mounts for shock absorbers 60, a lateral end stop 62, support mounts for linking rods 78 and support mounts for brakes 82.

The manufacturing method comprises, subsequently, an assembly step for assembling and welding of metal sheets in order to form at least two stringers 30, each comprising two flanks 46, 47, one central core 50 linking the two flanks 46, 47 to each other, and two end cores 54, 55.

The manufacturing method comprises, subsequently, a step of attachment by means of welding, of the ribs 58, 59, on each stringer 30.

The manufacturing method comprises, subsequently, an assembly step for assembling of stringers 30 by making use of the transverse tubes 34, 35, 36, 37. During this step, the transverse tubes 34, 35, 36, 37 are inserted into the holes 74 of the second flanks 47 of each stringer 30 until they come to abut against the first flank 46 of this stringer 30.

The transverse tubes 34, 35, 36, 37 are then welded on to the end cores 70, 71, on the central cores 50 and on to the first flanks 46 of each stringer 30.

The manufacturing method comprises, subsequently, a step of attachment by means of welding, of the support mounts for shock absorbers 60 on to the first flanks 46 of the stringers 30 and of attachment by welding of the lateral end stop 62 on to the second flank 47 of one of the stringers 30.

The attachment step comprises, in addition, the attachment by welding of the support mounts for linking rods 78 and the support mounts for brakes 82 on to the transverse tubes 34, 35, 36, 37.

Thus, the manufacture of the stringers 30 by making use of substantially planar metal sheets that are cut and not folded makes it possible in the first place to do away with a support member such as a box shaped casing.

The absence of the box shaped casing provides the ability to significantly reduce the mass of the frame. The gain in terms of lower frame mass is, thus, estimated at around 30% as compared to a frame comprising box shaped casings.

In addition, the bogie frame is effectively more tightly sealed than the frame of the state of the art by virtue of the absence of box shaped casing.

The quality of welds is improved and the risk of oxidation of the frame is decreased. In addition, it is possible to effect the welding of the frame by means of a device such as a robot due to the absence of complex component parts to be assembled, which thereby facilitates the manufacture of the frame. In addition, the machining time for the frame is reduced by close to 50% as compared to a frame with box shaped casing.

The manufacture of the frame is thus simpler, more easily controllable and therefore less expensive.

The frame according to the invention is also adaptable to the extent where the transverse tubes 34, 35, 36, 37 and/or stringers 30 are easily adjustable in terms of dimension.

Advantageously, each flank 46, 47 is fabricated integrally in one single piece, that is to say, that each flank is formed of one single piece from one single metal sheet.

Preferably, the central core 50 extends substantially horizontally in the longitudinal direction, that is, the normal to the central core 50 is contained in a transverse plane.

What is claimed is:

1. A bogie frame for a railway vehicle comprising:

at least two stringers, each of the stingers comprising, two flanks and at least one central core, the central core of a stringer linking the two flanks of the stringer to each other; and at least one transverse tube linking the two stringers to each other;

wherein each of the two flanks of each stringer and the central core of each stringer are formed of a single piece of a cut metal sheet which are substantially planar and not folded.

2. The bogie frame according to claim 1, wherein the each flank of each stringer comprises a central part extending along a longitudinal axis and two exterior parts extending along the longitudinal axis, the two exterior parts being distributed along the longitudinal axis on either side of the central part and each one forming an angle with the central part of the flank.

3. The bogie frame according to claim 2, wherein the central core of each stringer links the central parts of the flanks of the stringer to each other, and in that a stringer comprises at least two end cores linking, two by two, the exterior parts of the flanks of the stringer belonging to two separately distinct flanks each end core being formed from a cut metal sheet that is substantially planar and not folded.

4. The bogie frame according to claim 3, wherein the exterior parts of the flanks of each stringer located at one of the ends of the central parts of the flanks of the stringer are symmetrical to the exterior parts of the flanks of the stringer located at the other end of the central parts of the flanks of the stringer in relation to a vertical plane passing through the center along the longitudinal axis of the central parts of each stringer and in that the end cores of a flank follow the shape of the exterior parts of the flank and are each symmetrical to one another in relation to the plane.

5. The bogie frame according to claim 3, wherein the central core and the end cores of a stringer are welded on to the transverse tube and to the flanks of the stringer.

6. The bogie frame according to claim 2, wherein it comprises two transverse end tubes linking the exterior parts of different separate stringers and two central transverse tubes linking the central parts of different separate stringers.

7. The bogie frame according to claim 1, wherein at least one stringer comprises at least one rib linking the flanks of the stringer to one another.

8. The bogie frame according to claim 7, wherein at least one rib has a function of support of an anti-roll bar.

9. A bogie comprising the bogie frame according to claim 1.

10. A manufacturing method of a bogie frame for a railway vehicle, the method comprising:

supplying cut metal sheets which are substantially planar and not folded;

supplying at least one transverse tube;

assembling the cut metal sheets to form at least two stringers, each of the stringers comprising, two flanks and at least one central core, wherein each of the two flanks of each stringer and the central core of each stringer are formed of a single piece of a cut metal sheet, and the at least one central core of each of the stringers link the two flanks of each of the stringers to one another; and linking the at least two stringers to each other via the at least one transverse tube in order to form a bogie frame.

* * * * *